United States Patent [19]

Shibata et al.

[11] Patent Number: 4,468,921

[45] Date of Patent: Sep. 4, 1984

[54] AIR NOZZLE FOR PRODUCING FANCY YARN

[75] Inventors: Kunio Shibata; Tomotsugu Kanamura, both of Nagoya; Tunehiko Nakamura, Kani, all of Japan

[73] Assignee: Mitsubishi Rayon Co., Ltd., Tokyo, Japan

[21] Appl. No.: 487,826

[22] Filed: Apr. 22, 1983

[30] Foreign Application Priority Data

Jul. 1, 1982 [JP] Japan ..... 57-114691

[51] Int. Cl.[3] ..... D02G 3/34

[52] U.S. Cl. ..... 57/333; 57/6; 57/350

[58] Field of Search ..... 57/5, 6, 3, 333, 350; 28/271-276

[56] References Cited

U.S. PATENT DOCUMENTS

| | | | |
|---|---|---|---|
| 3,336,753 | 8/1967 | Marshall | 57/6 X |
| 3,403,501 | 10/1968 | Nuissl | 57/333 |
| 3,438,186 | 4/1969 | Marshall | 57/6 |
| 3,568,424 | 3/1971 | Marshall | 57/6 |
| 3,812,665 | 5/1974 | Holland | 57/6 |
| 4,073,129 | 2/1978 | Ostrowski et al. | 57/333 X |
| 4,077,197 | 3/1978 | Bowden et al. | 57/333 X |

*Primary Examiner*—John Petrakes

*Attorney, Agent, or Firm*—Oblon, Fisher, Spivak, McClelland & Maier

[57] ABSTRACT

An air nozzle for producing a sheath-core type fancy yarn, comprising a hollow cylindrical nozzle body in which a vortex occurs around an axis thereof due to a suction flow of a subatmospheric pressure source. Within the nozzle body a conical cap and a ring body are arranged in series. A sheath yarn is overfed into the nozzle body in the tangential direction to the inner surface of the body and wraps around the conical cap to form a plurality of loops due to the vortex, then entangles a core yarn running straight through the nozzle body. Since an outer surface of the conical cap and a central opening of the ring body guide the vortex smoothly along a yarn path, a fancy yarn having uniformly and tightly entangled loops can be obtained.

3 Claims, 3 Drawing Figures

Fig. 2
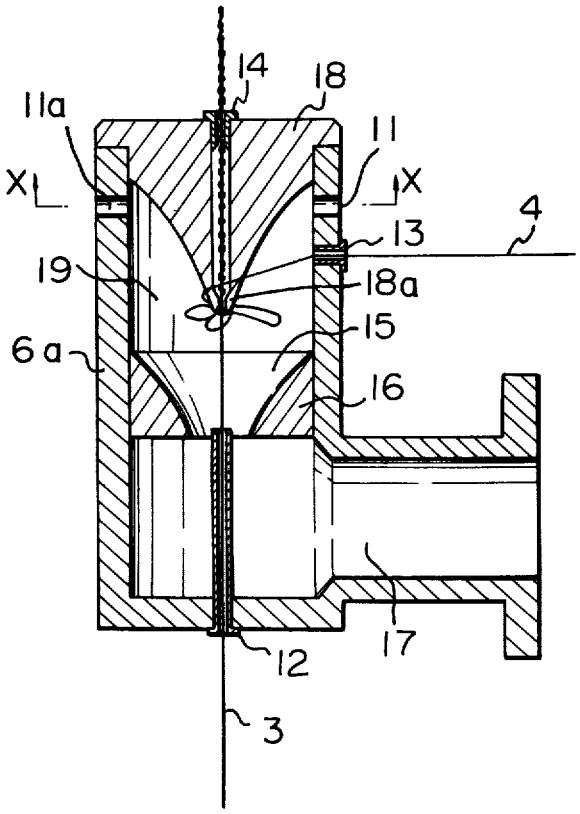
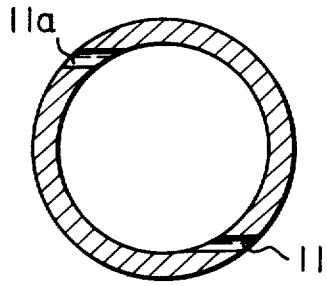
Fig. 3

AIR NOZZLE FOR PRODUCING FANCY YARN

BACKGROUND OF THE INVENTION

1. Field of the Invention

The present invention relates to an air nozzle suitable for producing a sheath-core type fancy yarn in which a sheath yarn is entangled around a core yarn to form a plurality of loops by a suction vortex caused in the air nozzle.

2. Description of the Prior Art

A prior art air nozzle, disclosed in Japanese Unexamined Patent Publication (Kokai) No. 53-14856 by the persent inventors, comprises a hollow cylindrical body having a first inlet for a core yarn at one end thereof and at least a second inlet for a sheath yarn and a third inlet for operating fluid. The second and third inlets are tangentially bored in a circumferential wall of the body in the vicinity of the other end thereof. The body is further provided with a suction orifice for the fluid in its circumferential wall in the vicinity of the first inlet. The air nozzle further comprises a conical cap having a yarn draw-off passage through an axis thereof, coaxially inserted into the body through the other end of the body. The apex of the cap is disposed between the suction orifice and the second inlet to form an annular space between the inner surface of the body and the outer surface of the conical cap.

The prior art air nozzle, however, was found to be unsuitable for a tightly entangled fancy yarn having a plurality of uniform loops, even with strictly controlled process conditions.

Another problem with the prior art was that the resultant fancy yarn was easily separated into the starting yarns during post-processing such as knitting or weaving.

SUMMARY OF THE INVENTION

It an object of the present invention to eliminate the above-mentioned drawbacks of the prior art.

It is another object of the present invention to improve the prior art air nozzle, thereby providing a fancy yarn having a plurality of loops of sheath yarn tightly and uniformly entangled around a core yarn.

The above-mentioned object can be attained by an air nozzle of the structure of the above-mentioned prior art air nozzle, wherein a ring body having a central opening is coaxially mounted within the hollow cylindrical body between the apex of the conical cap and the orifice.

BRIEF DESCRIPTION OF THE DRAWINGS

The present invention will now be more fully described referring to the accompanying drawings; in which:

FIG. 2 is a sectional side view of the nozzle according to the present invention; and FIG. 3 is a sectional plan view of the nozzle along line X-X of FIG. 2.

DESCRIPTION OF THE PREFERRED EMBODIMENT

Figure 1:
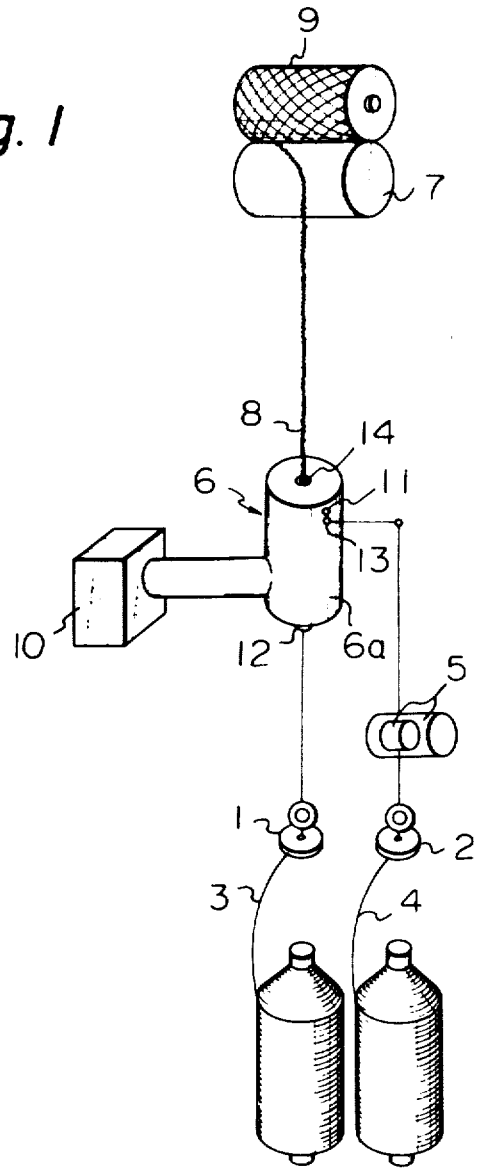
FIG. 1 is an oblique view of an apparatus utilizing an air nozzle according to the present invention.

The general principle for producing a fancy yarn will be described by referring to FIG. 1, illustrating an apparatus utilizing an air nozzle according to the present invention.

The apparatus comprises a pair of tension regulators 1, 2, through which a core yarn 3 and a sheath yarn 4 are fed, respectively; a pair of feed rollers 5, 5 by which the sheath yarn 4 is overfed relative to the core yarn 3; an air nozzle 6 according to the present invention; and a winding drum 7 on which a resultant fancy yarn 8 is taken up as a cheese 9.

The air nozzle 6 has a hollow cylindrical body 6a communicated to a subatmospheric pressure source 10. A vortex occurs within the body 6a due to a suction stream from an inlet 11 provided on a circumferential wall of the body 6a.

The core yarn 3 is introduced into the body 6a through a first inlet 12 provided at a bottom end thereof. The sheath yarn 4 is delivered into the body 6a by the feed rollers 5, 5 through a second inlet 13 provided in the vicinity of the third inlet 11. The feed rate of the sheath yarn 4 is several times that of the core yarn 3. The excess length of the sheath yarn 4 entangles around the core yarn 3 forming a plurality of loops within the body 6a. The resultant fancy yarn 8 is drawn off from a yarn draw-off passage 14 provided on a top end of the nozzle 6 and is wound on the winding drum 7.

The structure of the air nozzle will now be explained in detail referring to FIGS. 2 and 3.

As described before, the nozzle 6 comprises the hollow cylindrical body 6a. At a bottom end of the body 6a is provided the inlet 12 for the core yarn 3 (hereinafter referred to as "first inlet"). The first inlet 12 has a tubular form which protrudes into the interior of the body 6a up to a central opening 15 of a ring body 16. At an upper circumferential wall of the body 6a is provided the tangentially bored inlet 13 for the sheath yarn 4 (hereinafter referred to as "second inlet").

The body 6a also has a pair of inlets 11, 11a for operating fluid in the vicinity of the second inlet 13 (hereinafter referred to as "third inlets").

The third inlets 11, 11a are preferably arranged symmetrically relative to an axis of the body 6a and are bored tangentially to the inner surface of the body 6a, as shown in FIG. 3.

At a lower portion of the circumferential wall of the body 6a is opened a suction orifice 17 communicating to the subatmospheric pressure 10 (not shown in FIG. 2).

A top end of the body 6a is closed by a conical cap 18. The cap 18 has the yarn draw-off passage 14 along a center axis thereof and is inserted into the interior of the body 6a in such a manner that an apex 18a is disposed between the third inlets 11, 11a and the orifice 17. An annular space 19 is thus formed between the inner surface of the body 6a and the outer surface of the conical cap 18.

The ring body 16 is mounted in the body 6a just below the annular space 19. The ring body 16 has the central opening 15, the shape of which is approximately identical to the outer surface of conical cap 18.

When the subatmospheric pressure source 10 is connected to the body 6a, air streams are sucked into the interior of the body 6a through the third inlets 11 and 11a. The tangential-direction air streams create a vortex within the annular space 19. The sheath yarn 4 overfed by the feed rollers 5, 5 is sucked into the body 6a through the second inlet 13 and is whirled around the conical cap 18 by the vortex. The sheath yarn 4 wraps around the conical cap 18 forming loops and slips down along an inclination of the cap 18. At the apex 18*a*, the loops of the sheath yarn 4 successively entangle to the core yarn 3 running into the yarn draw-off passage 14, resulting in the fancy yarn 8.

Due to the arrangement of the ring body 16, the vortex is controlled to be converged concentratedly to the apex 18*a* and, thereafter, to be removed downward without disturbing the concentrated flow. The above-mentioned controlled vortex enhances uniform generation of small loops and tight entanglement thereof around the core yarn 3.

It is preferable that the conical cap 18 have a concaved outer surface and that the ring body 16 have a convexed central opening 15 of a trumpet form corresponding to the former, because such shapes serve to guide the vortex stably to the orifice 17.

Further, since the first inlet 12 of the core yarn 3 protrudes into the central opening 15, the core yarn 3 can be protected from vibration caused by the removed air flow directed to the orifice 17, such vibration obstructing the steady feed of the core yarn 3.

In order to maintain stable feed, the second inlet 13 is preferably provided at a height between the third inlet 11 and 11*a* and the apex 18*a* of the conical cap 18 and is preferably of as small a diameter as possible but still allowing the sheath yarn 4 to pass therethrough.

The air nozzle 6 of the present invention may have a plurality of second inlets, thereby producing a fancy yarn having more than one sheath yarn.

Further, the apparatus may be arranged so that two air nozzles as shown in FIG. 2 are disposed in series, thereby allowing a double layered fancy yarn to be obtained. In this case, various fancy yarns can be produced by providing each of the two air nozzles with tangential inlets directed opposite from each other.

We claim:

1. An air nozzle for producing a fancy yarn, comprising:

a hollow cylindrical body having a first inlet for a core yarn at one end thereof and at least a second inlet for a sheath yarn and at least a third inlet for operational fluid, the second and third inlets being tangentially bored in a circumferential wall of said body in the vicinity of the other end thereof, and being provided with a suction orifice for said fluid in a circumferential wall of said body in the vicinity of said first inlet;

a conical cap having a yarn draw-off passage through an axis thereof, coaxially inserted into said body through the other end of said body, an apex of said cap being disposed between said suction orifice and said second inlet, so that an annular space is formed between an inner surface of said body and an outer surface of said conical cap;

characterized in that a ring body having a central opening is coaxially mounted within said body between said apex of said conical cap and said orifice.

2. An air nozzle according to claim 1, in which said conical cap has a concaved outer surface and said ring body has a convexed central opening of a trumpet form.

3. An air nozzle according to claim 1, in which said first inlet is a tubular form protruding into said nozzle body up to said central opening of said ring body.

* * * * *